US011057712B2

(12) United States Patent
Zhang

(10) Patent No.: US 11,057,712 B2
(45) Date of Patent: Jul. 6, 2021

(54) SPEAKER

(71) Applicant: AAC Technologies Pte. Ltd., Singapore (SG)

(72) Inventor: Guqing Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 70 days.

(21) Appl. No.: 16/706,800

(22) Filed: Dec. 8, 2019

(65) Prior Publication Data

US 2020/0213762 A1 Jul. 2, 2020

(30) Foreign Application Priority Data

Dec. 30, 2018 (CN) ..... 201822279149.4

(51) Int. Cl.

| | |
|---|---|
| ***H04R 11/02*** | (2006.01) |
| ***H04R 9/00*** | (2006.01) |
| ***H04R 9/06*** | (2006.01) |
| ***H04R 9/02*** | (2006.01) |
| ***H04R 1/02*** | (2006.01) |
| ***H04R 9/04*** | (2006.01) |

(52) U.S. Cl.

CPC ..... *H04R 9/06* (2013.01); *H04R 1/02* (2013.01); *H04R 9/027* (2013.01); *H04R 9/04* (2013.01); *H04R 2400/11* (2013.01); *H04R 2499/11* (2013.01)

(58) Field of Classification Search

CPC .. H04R 1/02; H04R 1/2873; H04R 2209/024; H04R 2400/11; H04R 2499/11; H04R 31/006; H04R 9/04; H04R 9/06

USPC ..... 381/116–117, 396, 412

See application file for complete search history.

(56) References Cited

U.S. PATENT DOCUMENTS

2011/0051987 A1* 3/2011 Ueda ..... H04R 9/06 381/412

2017/0117789 A1* 4/2017 Mao ..... H02K 33/00

* cited by examiner

*Primary Examiner* — George C Monikang

(74) *Attorney, Agent, or Firm* — W&G Law Group LLP

(57) ABSTRACT

A speaker includes a shell, a magnetic circuit unit, and a vibration unit. The magnetic circuit unit includes a yoke and a magnet. The yoke includes a bottom wall connected to the magnet. The bottom wall includes an upper surface close to the vibration unit, and a lower surface opposite to the upper surface. A first groove and a second groove that are spaced apart from each other are formed on the upper surface by recessing towards the lower surface. An orthographic projection of the magnet on the upper surface along a vibrating direction of the vibration unit completely covers the first groove. The second groove is arranged outside the orthographic projection. The magnet and the bottom wall are glued and connected by a glue. The glue is received in the first groove. In the speaker, the magnet is firmly connected and is unlikely to be detached.

10 Claims, 5 Drawing Sheets

SPEAKER

TECHNICAL FIELD

The present invention relates to the technical field of electroacoustic conversion, and in particular, to a speaker used in portable electronic products.

BACKGROUND

With the advent of the mobile internet era, more and more smart mobile devices emerge. Among the various mobile devices, mobile phones are undoubtedly the most common and portable mobile terminal devices. At present, mobile phones have extremely diverse functions, one of which is high-quality music playing. Therefore, speakers for playing sound are widely used in smart mobile devices nowadays.

In the related art, a magnet and a yoke of a speaker are bonded and fixed by a glue. The glue is applied between the yoke and the magnet, which are bonded and fixed after being pressed by a pressing machine. The magnet is likely to be detached when falling on the ground due to a small amount of applied glue.

Therefore, it is urgent to provide a new speaker to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present invention. Moreover, in the drawings, like reference numerals designate corresponding parts throughout the several views.

DESCRIPTION OF EMBODIMENTS

The present invention will hereinafter be described in detail with reference to several exemplary embodiments. To make the technical problems to be solved, technical solutions and beneficial effects of the present invention more apparent, the present invention is described in further detail together with the figure and the embodiments. It should be understood the specific embodiments described hereby is only to explain the invention, not intended to limit the invention.

Figure 1:
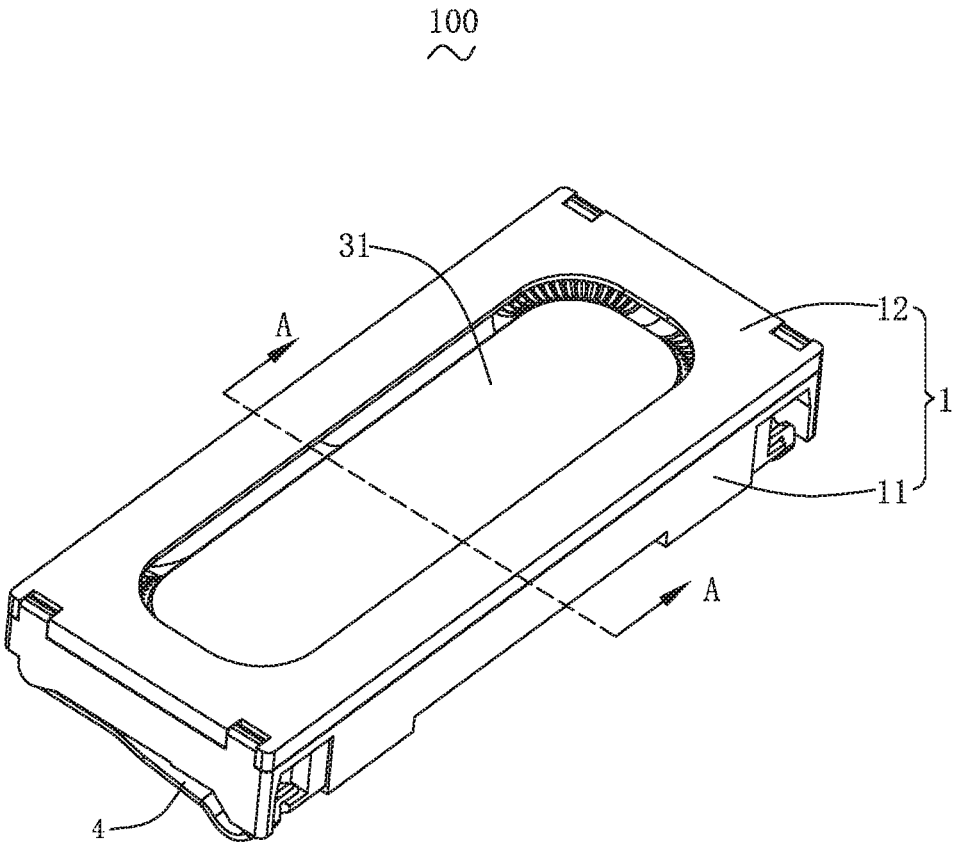
FIG. 1 is a perspective structural schematic view of a speaker according to an embodiment of the present invention.
Figure 2:
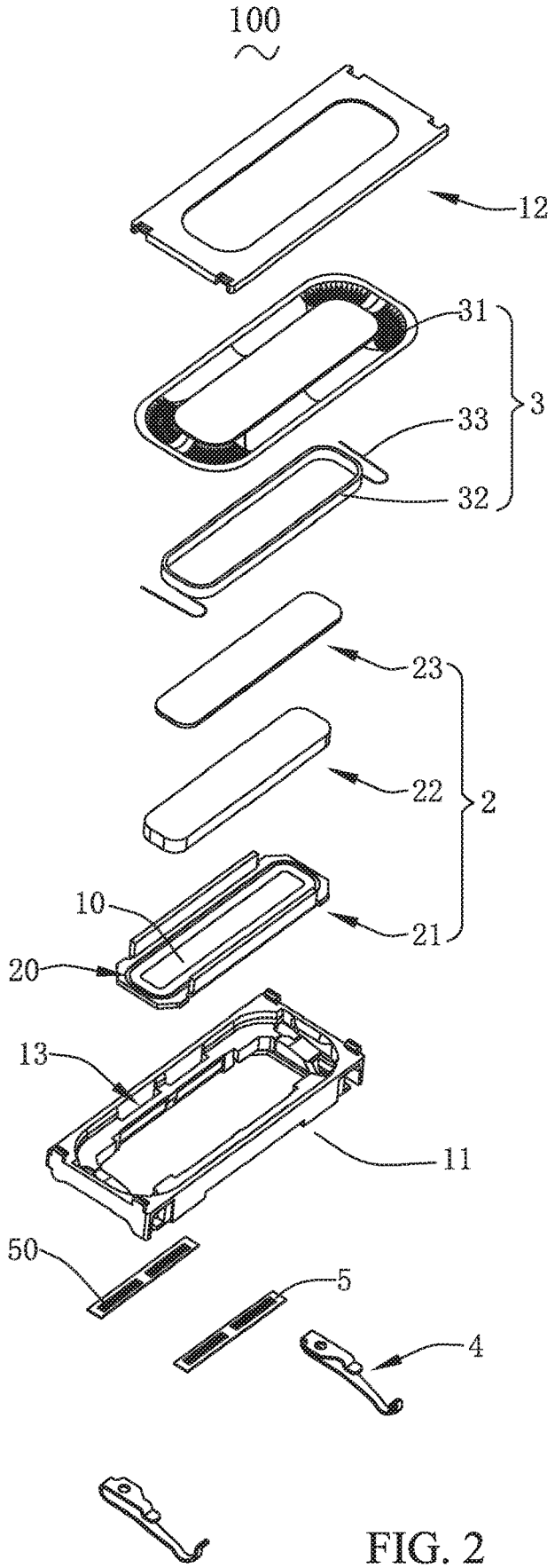
FIG. 2 is an exploded structural view of a speaker according to an embodiment of the present invention.

As shown in FIGS. 1 and 2, the present invention provides a speaker 100. The speaker 100 includes a shell 1, a magnetic circuit unit 2, a vibration unit 3, a conductive terminal 4, and a steel sheet 5. The shell 1 has a receiving space. The magnetic circuit unit 2 is received in the receiving space. The vibration unit 3 is fixed to and held by the shell 1 and has a diaphragm 31. The conductive terminal 4 connects the vibration unit 3 with an external power supply. The steel sheet 5 is fixedly connected to the shell 1.

The shell 1 is configured to receive and protect other components of the speaker 100. In an embodiment, the shell 1 has a rectangular frame shape. The shell 1 includes a holder 11, an upper cover 12 covering the holder 11, and a through-hole 13 penetrating through the shell 1. The holder 11 defines the receiving space together with the upper cover 12. An inner cavity is defined between a side of the diaphragm 31 close to the magnetic circuit unit 2 and the shell 1. The through-hole 13 is in communication with the inner cavity. The through-hole 13 is arranged at a side of the holder 11 facing away from the upper cover 12.

The magnetic circuit unit 2 is configured to drive the vibration unit 3 to vibrate and emit sound. The magnetic circuit unit 2 includes a yoke 21 fixedly connected to the shell 1, a magnet assembled to the yoke 21, and a pole plate 23 bonded to the magnet 22.

Figure 3:
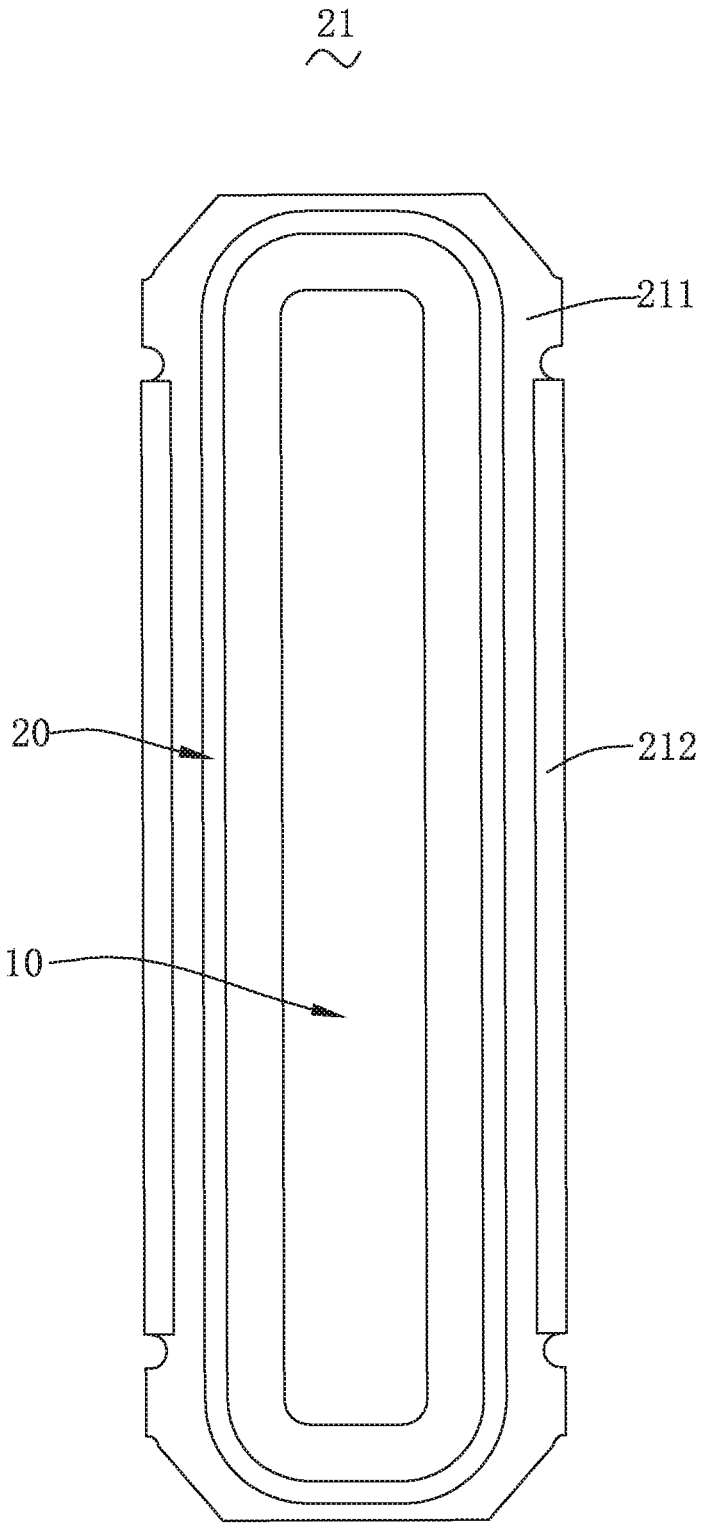
FIG. 3 is a front view of a yoke shown in FIG. 2.

As shown in FIG. 3, in this embodiment, the yoke 21 has a bowl-like structure, and a magnetic gap is formed between the magnet 22 and the yoke 21. The yoke 21 includes a bottom wall 211 connected to the magnet 22, and a side wall 212 extending from two opposite ends of the bottom wall 211 while being bent towards vibration unit 3. The bottom wall 211 and the side wall 212 define an accommodating space. The magnet 22 is received in the accommodating space. A magnetic gap is formed between the side wall 212 and the magnet 22. In other embodiments, the yoke 21 has a flat plate structure. The magnetic gap is formed by providing an auxiliary magnet spaced apart from the magnet 22 on the yoke 21, which shall fall within the protection scope of the present invention without affecting the correct description of the present invention.

Figure 4:
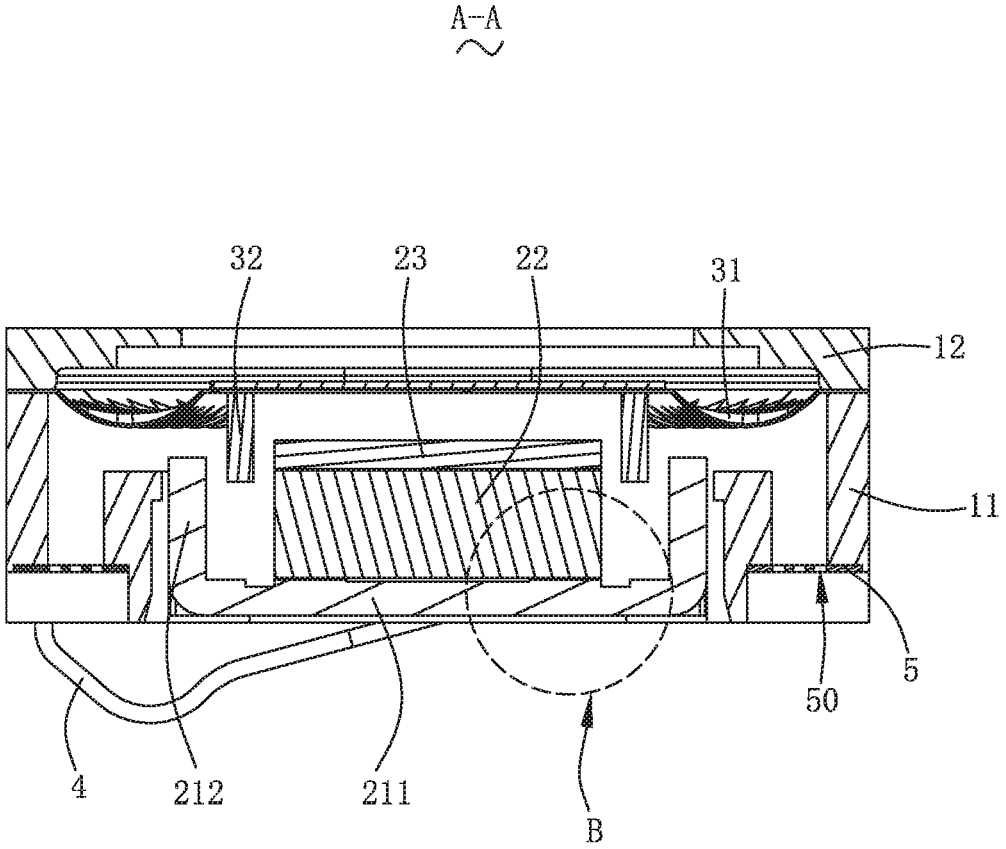
FIG. 4 is a cross-sectional view of the speaker taken along line A-A shown in FIG. 1.
Figure 5:
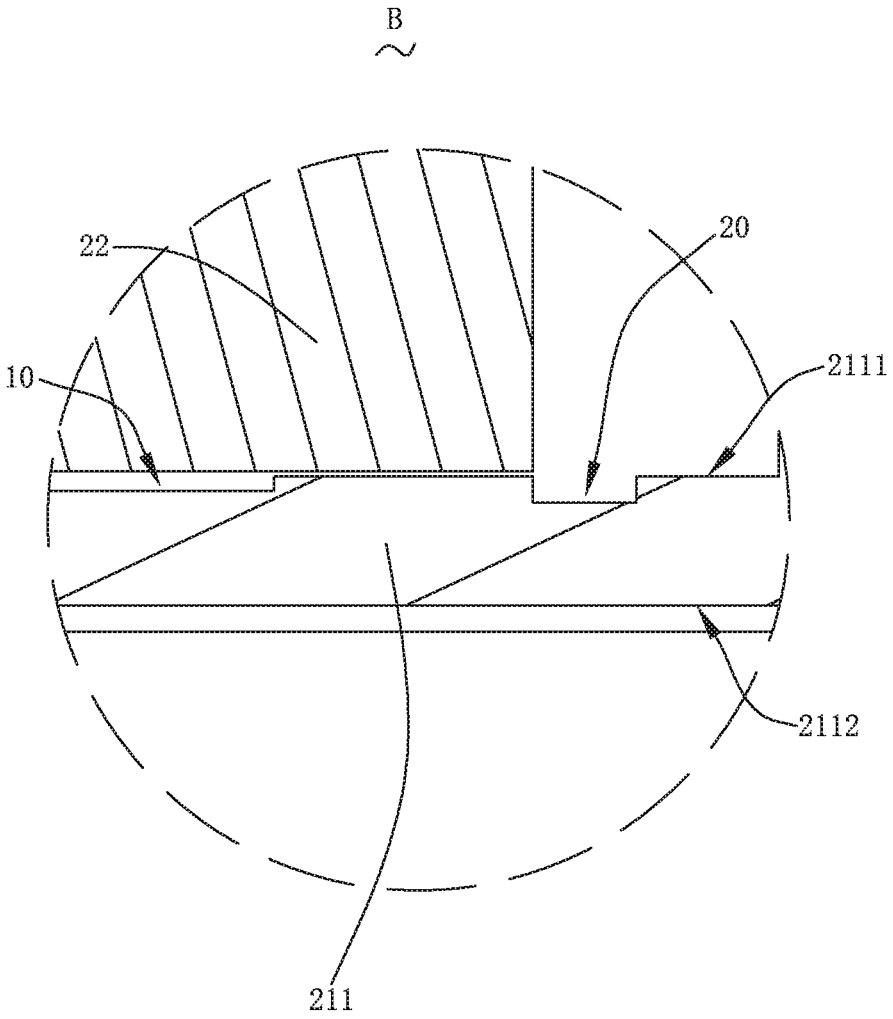
FIG. 5 is an enlarged view of a region B shown in FIG. 4.

As shown in FIG. 3 to FIG. 5, the bottom wall 211 includes an upper surface 2111 close to the vibration unit 3, and a lower surface 2112 spaced apart from and opposite to the upper surface 2111. A first groove 10 and a second groove 20 that are spaced apart from each other are formed on the upper surface 2111 by recessing towards the lower surface 2112. An orthographic projection of the magnet 22 on the upper surface 2111 along a vibrating direction of the vibration unit 3 completely covers the first groove 10. The second groove 20 is arranged outside the range of the orthographic projection. The magnet 22 and the bottom wall 211 are bonded and connected by a glue received in the first groove 10. The glue is an anaerobic adhesive, which is characterized by curing upon absence of oxygen on surfaces to be glued. The pole plate 23 is fixed to a side of the magnet 22 facing away from the upper surface 2111.

It should be understood that, compared with the related art, the first groove 10 for hiding the glue can increase the amount of glue for bonding the magnet 22 to the bottom wall 211. Meanwhile, the glue is in contact with bottom surface and side surface of the first groove 10, i.e., the contact area is increased, thereby improving the gluing effect. In this way, the magnet 22 is unlikely to be detached once being connected to the bottom wall 211.

During installation, an excessive amount of glue, i.e., greater than a volume of the first groove 10, is filled into the first groove 10, and the excess glue overflows from the first recess 10 into the second recess 20 when the bottom wall 211 and the magnet 22 are assembled by pressing. In this case, the glue is applied between the bottom wall 211 and the magnet 22, and then the magnet 22 and the bottom wall 211 are pressed to extrude oxygen remained between the bottom wall 211 and the magnet 22. Then, the glue between the bottom wall 211 and the magnet 22 is solidified to form a gluing connection between the yoke 21 and the magnet 22. It should be understood that, after the bottom wall 211 is bonded to the magnet 22, a seal portion is formed to inhibit oxygen from entering the first groove 10. In this case, the glue in the first groove 10 is solidified, and thus the connection between the yoke 21 and the magnet 22 is further strengthened. Meanwhile, the overflowing glue is received in the second groove 20, and the glue in the second groove 20 cannot be solidified due to the presence of oxygen, which can be removed by another process without occupying the vibration space of the vibration unit 2. For example, an outer edge of the orthographic projection of the magnet 22 on the upper surface 2111 coincides with an inner edge of the second groove 20, in order to ensure that excess glue can smoothly overflow into the second groove 20. A distance between the first groove 10 and the second groove 20 is in a range of 0.2 mm to 1 mm, which can guarantee a better sealing effect. In addition, the first groove 10 has a larger cross-sectional area to receive more glue.

Further, the first groove 10 has a smaller depth than the second groove 20, so that the second groove 20 can receive more overflowing glue.

The first groove 10 faces right the magnet 22, and has a rectangular shape. The second groove 20 has a closed loop shape, and symmetrically surrounds an outer circumference of the first groove 10, so that the yoke 21 has an overall symmetrical structure, and the vibration effect of the speaker 100 is not affected.

The vibration unit 3 is configured to vibrate and emit sound. The vibration unit 3 includes a diaphragm 31 configured to vibrate and emit sound, a voice coil 32 located below the diaphragm 31 and configured to drive the diaphragm 31 to vibrate and emit sound, and a coil lead 33 extending from the voice coil 32. The diaphragm 31 is sandwiched between the upper cover 12 and the holder 11. The voice coil 32 is suspended in the magnetic gap.

The conductive terminal 4 connects the coil lead 33 with the external power supply to form an electrical connection between the voice coil 32 and the external power supply.

The steel sheet 5 is fixed to the holder 11 and covers the through-hole 13. The steel sheet 5 is provided with a leakage hole 50 that communicates the through-hole 13 with the outside. The leakage hole 50 breaks the seal of the inner cavity, destroys the resonance condition of the inner cavity, so that the resonance is weakened and the distortion is reduced. Meanwhile, the leakage hole 50 can balance the air pressure inside the speaker, thereby effectively improving the acoustic quality of the speaker.

Compared with the related art, in the speaker 100 provided by the present invention, the first groove 10 for receiving glue arranged on the bottom wall 211 of the yoke 21 increases the gluing area, improves the gluing stability, and prevents the magnet 22 from falling. In addition, the glue is anaerobic, and the excess glue overflows from the first groove 10 into the second groove 20. After pressing, the bottom wall 211 and the magnet 22 are bonded and form a sealing portion. The glue in the first groove 10 is solidified to form the connection between the magnet 22 and the bottom wall 211, while the overflowing glue is received in the second groove 20 without affecting the vibration space of the vibration unit 3.

The above described embodiments are merely intended to illustrate the present invention, and it should be noted that, without departing from the inventive concept of the present invention, the improvements made by those skilled in the related art shall fall within the protection scope of the present invention.

What is claimed is:

1. A speaker, comprising:

a shell having a receiving space;

a magnetic circuit unit received in the receiving space; and a vibration unit fixedly held at the shell, wherein the magnetic circuit unit comprises a yoke fixedly connected to the shell, and a magnet assembled to the yoke, and the yoke comprises a bottom wall connected to the magnet, the bottom wall comprises an upper surface close to the vibration unit and a lower surface opposite to the upper surface, a first groove and a second groove that are spaced apart from each other are formed on the upper surface by recessing towards the lower surface, an orthographic projection of the magnet on the upper surface along a vibrating direction of the vibration unit completely covers the first groove, the second groove is arranged outside the orthographic projection, the magnet and the bottom wall are glued and connected by a glue received in the first groove.

2. The speaker as described in claim 1, wherein the yoke further comprises a side wall extending from two opposite ends of the bottom wall while being bent towards the vibration unit, the side wall and the magnet are spaced apart, and the magnetic circuit unit further comprises a pole plate fixed to a side of the magnet facing away from the upper surface.

3. The speaker as described in claim 1, wherein the first groove has a smaller depth than the second groove.

4. The speaker as described in claim 1, wherein the first groove faces right the magnet and has a rectangular shape, and the second groove has a closed loop shape and symmetrically surrounds an outer circumference of the first groove.

5. The speaker as described in claim 4, wherein an outer edge of the orthographic projection of the magnet on the upper surface coincides with an inner edge of the second groove.

6. The speaker as described in claim 5, wherein a distance between the first groove and the second groove is in a range of 0.2 mm to 1 mm.

7. The speaker as described in claim 1, wherein the glue is an anaerobic glue.

8. The speaker as described in claim 2, wherein the vibration unit comprises a diaphragm fixedly connected to the shell and configured to vibrate and emit sound, a voice coil located below the diaphragm and configured to drive the diaphragm to vibrate, and a coil lead extending from the voice coil, the magnet is spaced apart from the side wall to form a magnetic gap, and the voice coil is suspended in the magnetic gap.

9. The speaker as described in claim 8, further comprising a conductive terminal, wherein the conductive terminal connects the coil lead with an external power supply to form an electrical connection between the voice coil and the external power supply.

10. The speaker as described in claim 8, wherein a side of the diaphragm close to the magnetic circuit unit and the shell define an inner cavity, and the shell is provided with a through-hole penetrating the shell and in communication with the inner cavity; and the speaker further comprises a steel sheet fixed to the shell and covering the through-hole, and the steel sheet is provided with a leakage hole communicating the through-hole with outside.

* * * * *